US008388471B2

(12) United States Patent
Morrow

(10) Patent No.: US 8,388,471 B2
(45) **Date of Patent: *Mar. 5, 2013**

(54) PITCHING SCREEN

(75) Inventor: William David Morrow, Bellvue, CO (US)

(73) Assignee: Morrow Sports, LLC, Bellvue, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/550,368

(22) Filed: Jul. 16, 2012

(65) Prior Publication Data

US 2012/0279042 A1 Nov. 8, 2012

Related U.S. Application Data

(63) Continuation of application No. 12/315,778, filed on Dec. 5, 2008, which is a continuation of application No. 11/601,566, filed on Nov. 17, 2006, now Pat. No. 7,462,115, which is a continuation of application No. 10/958,536, filed on Oct. 4, 2004, now Pat. No. 7,153,225.

(51) Int. Cl.
*A63B 69/00* (2006.01)

(52) U.S. Cl. ..... 473/454; 473/451; 473/197; 273/400

(58) Field of Classification Search ..... 473/422, 473/454–456, 434, 476, 478, 197; 273/401, 273/402, 407, 410
See application file for complete search history.

(56) References Cited

U.S. PATENT DOCUMENTS 2,938,524 A * 5/1960 Benson ..... 135/118
3,034,788 A 5/1962 Cauble
3,195,898 A 7/1965 Respini
3,394,720 A * 7/1968 Moss ..... 135/125
D214,896 S 8/1969 D'Agostinio et al.
3,685,482 A 8/1972 Ryder
4,253,670 A 3/1981 Moulton et al.
4,346,901 A 8/1982 Booth
4,364,562 A 12/1982 White et al.
4,398,722 A 8/1983 Morris et al.
4,625,974 A 12/1986 Andrews
4,750,508 A * 6/1988 Tatoian ..... 135/118
4,934,938 A 6/1990 Orlandi et al.
5,088,740 A 2/1992 Peterson
5,240,258 A 8/1993 Bateman
5,277,432 A 1/1994 Bateman
5,342,063 A 8/1994 O'Brien et al.
5,403,017 A 4/1995 Doss, III et al.
5,690,339 A 11/1997 Chen
6,083,124 A 7/2000 Williams
6,210,288 B1 4/2001 Kim
6,247,699 B1 6/2001 Macaluso
6,354,968 B1 3/2002 Nozato
6,543,776 B2 4/2003 Macaluso
6,672,980 B1 1/2004 Walsh
6,866,595 B1 3/2005 Elder et al.
6,878,078 B2 4/2005 Swanson
6,893,364 B1 5/2005 Gruntfeld
6,928,951 B2 8/2005 Huang
6,955,615 B1 10/2005 Cavell
7,153,225 B2 12/2006 Morrow
7,462,115 B2 12/2008 Morrow (Continued)

OTHER PUBLICATIONS

U.S. Appl. No. 12/315,778, filed Dec. 5, 2008.

(Continued)

*Primary Examiner* — Mitra Aryanpour
(74) *Attorney, Agent, or Firm* — Craig R. Miles; CR Miles, P.C.

(57) ABSTRACT

A pitching screen which provides a first pitching lane and a second pitching lane in a single pitching screen configuration to allow both left-handed pitchers and right-handed pitchers to pitch without repositioning the pitching screen.

12 Claims, 5 Drawing Sheets

U.S. PATENT DOCUMENTS

| | | | |
|---|---|---|---|
| 2003/0236140 | A1 | 12/2003 | Alford |
| 2005/0237173 | A1 | 10/2005 | Huang |

OTHER PUBLICATIONS

U.S. Appl. No. 13/199,128, filed Aug. 19, 2011.

Baseball TIPS.COM. Pro L-Screen, http://www.baseballtips.com, downloaded Sep. 23, 2004, 1 page.

Bassco. Pitching Screen, http://www.bassco.com/productinfo.php/products, downloaded Sep. 23, 2004, 1 page.

Cages-Plus. Portable Batting Cages With L-Screen, http:www.cagesplus.com, downloaded Sep. 23, 2004, 8 pages.

Fogdog Sports. ATEC Pitcher's L Screen, http://www.fodog.com/, downloaded Sep. 23, 2004, 2 pages.

Hitting World. Bownet Portable Pitching Screen. On-line catalog, http://www.hittingworld.com, originally dowonloaded Oct. 7, 2011, 2 total pages.

Online SPORTS.COM. Pitcher's Protective "L" Screen, http//www.onlinesports.com, downloaded Sep. 23, 2004, 2 pages.

2002 TOMARK Sports Catalog. pp. 47 protective screens, 48 practice screens and 53 batting aids; www.tomark.com.

* cited by examiner

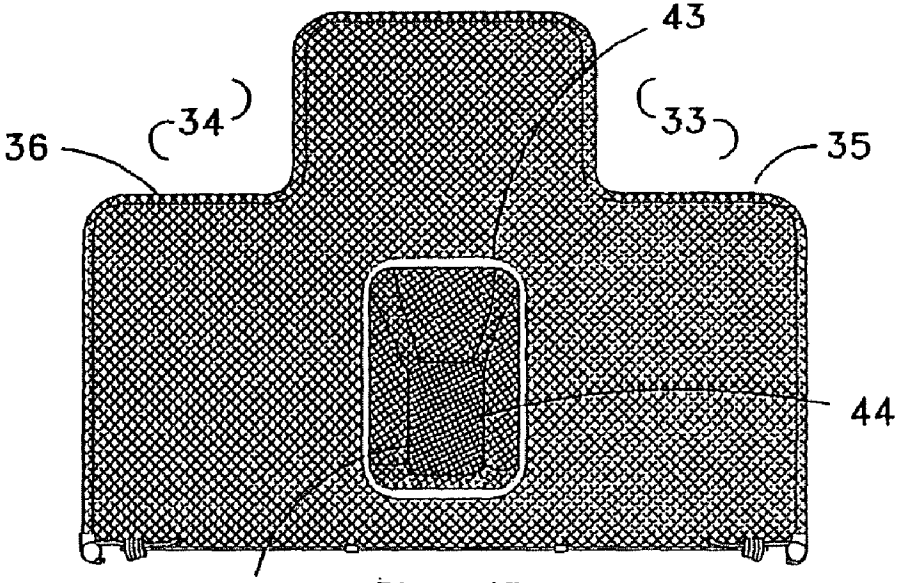
Fig. 4B
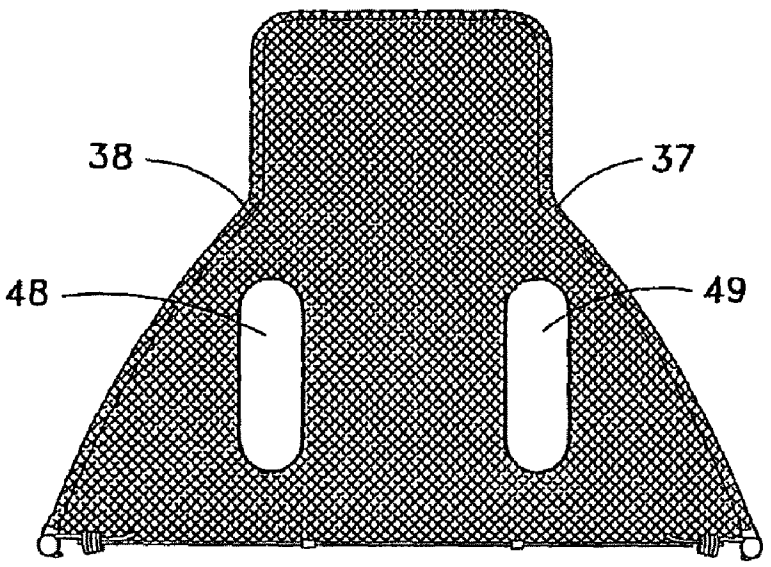
Fig. 4A
Fig. 4

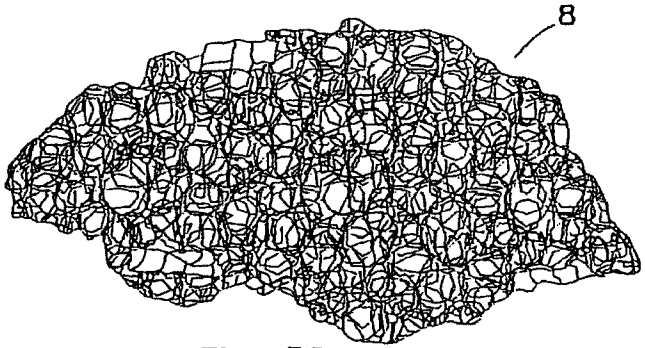
Fig. 5C
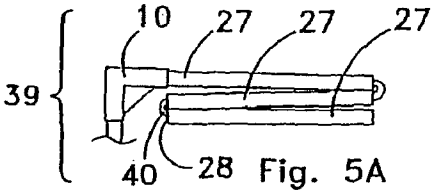
Fig. 5A
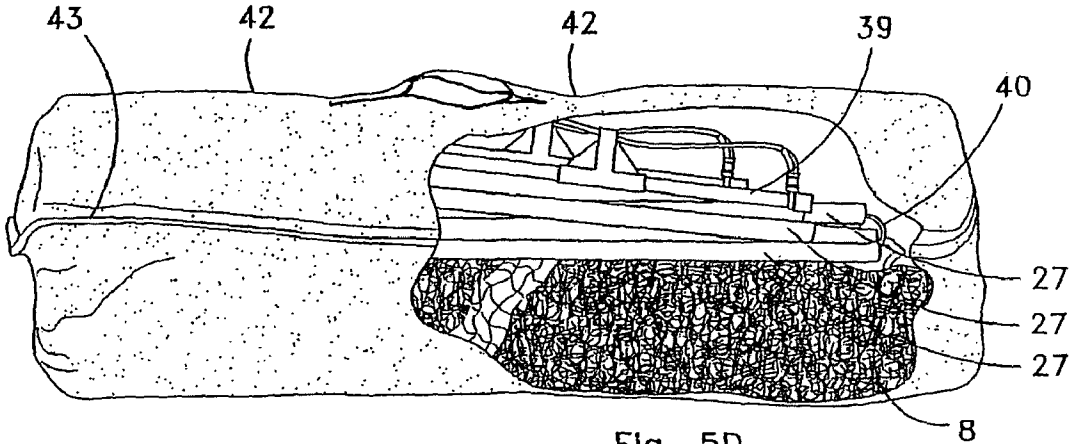
Fig. 5D
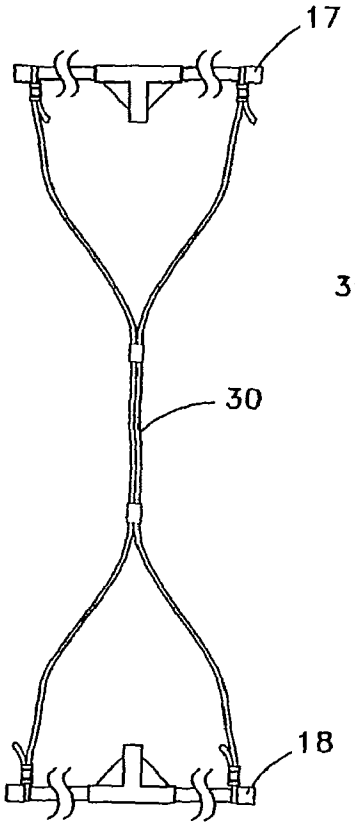
Fig. 5B
Fig. 5

PITCHING SCREEN

This United States Patent Application is a continuation of U.S. Continuation patent application Ser. No. 12/315,778, filed Dec. 5, 2008, which is a continuation of U.S. Continuation patent application Ser. No. 11/601,566, filed Nov. 17, 2006, now U.S. Pat. No. 7,462,115, issued Dec. 9, 2008, which is a continuation of U.S. patent application Ser. No. 10/958,536, filed Oct. 4, 2004, now U.S. Pat. No. 7,153,225, issued Dec. 26, 2006, each hereby incorporated by reference herein.

I. BACKGROUND

An ambidextrous pitching screen which provides in a single configuration a first pitching lane and a second pitching lane allowing both left-handed pitchers and right-handed pitchers to serially pitch from behind the same pitching screen without repositioning the pitching screen to accommodate the pitchers' handedness.

Conventional pitching screens have an L-shaped configuration which supports a net to deflect batted balls. The L-shaped configuration of conventional pitching screens provides a single pitching lane in a square or rectangular cutout on one side of an otherwise square pitching screen. The L-shaped configuration of pitching screen is first positioned with the square cutout on the right side for right handed pitchers and is then repositioned to locate the square cutout on the left hand side for left hand pitchers.

Even though there is large commercial market for pitching screens and numerous manufacturers have met the demand of that commercial market with a variety of conventional L-shaped configuration pitching screens, there are still a number of problems unresolved by conventional L-shaped configuration pitching screen technology.

A significant problem with conventional L-shaped configuration pitching screen technology can be that it does not accommodate both left-handed pitchers and right-handed pitchers without being repositioned to accommodate the handedness of the pitcher. An L-shaped screen must first be positioned to accommodate a left handed pitcher and then positioned a second time to accommodate a right handed pitcher. Repositioning the L-shaped screen between pitchers can be distracting to the pitcher or the batter and reduces the time for pitching or batting practice.

Another significant problem with conventional L-shaped configuration pitching screen technology can be that the square or rectangular cutout does not entirely protect the pitcher after the release of the pitch. After release of the pitch, the profile of the pitcher's body places the pitching shoulder and upper back in the area of the cutout as shown by FIG. 1A. Batted balls having a trajectory through the cutout can hit the pitcher in the pitching shoulder or upper back. Certain manufacturers have attempted to address this problem by configuring the net supported by conventional L-shaped pitching screens to extend into a portion of the square cutout.

Another significant problem with conventional pitching screen technology can be that the support frame may not break down into smaller components. Pitching screens can typically be seven feet high by seven feet wide with a cutout of three and one-half feet by three and one-half feet. As such, pitching screens that do not break down can be difficult to store and transport.

Another significant problem with conventional pitching screen technology can be that disassembly yields numerous separate loose components. These loose components can be easily misplaced or can take additional time to locate for reassembly.

Yet another significant problem with conventional pitching screen technology can be that assembled discrete components do not afford any manner of securement against disassembly during use. As such, conventional couplings between component parts can for example disassemble during use as the pitching screen is turned to accommodate a different handed pitcher, inadvertently struck by the pitcher during use, or when hit by batted balls.

The instant invention addresses each of these problems with conventional pitching screen technology.

II. SUMMARY OF THE INVENTION

Accordingly, a broad object of the invention can be to provide a pitching screen having support structure which allows both left-handed pitchers and right-handed pitchers to serially pitch from behind the same pitching screen without first accommodating the pitcher's handedness by repositioning the pitching screen.

A second broad object of the invention can be to provide a pitching screen having a support structure configured to protect the pitcher in the position that results after normal follow through from a pitch. As shown by FIG. 1A, the portion of the pitcher's body after throwing a pitch has an arcuate profile which may not be protected by a conventional L-shaped pitching screens.

A third broad object of the invention can be to provide a pitching screen which assembles from linear segments readily portable in a single container by a single person on foot.

A fourth broad object of the invention can be to provide a pitching screen assembled from segments having elastically tensioned couplings which resist disassembly during use of the pitching screen.

Naturally, further objects of the invention are disclosed throughout other areas of the specification, drawings, photographs, and claims.

III. A BRIEF DESCRIPTION OF THE DRAWINGS

FIG. 3F provides and enlargement of an embodiment of an elastically tensioned coupling between linear support segments.

FIG. 3G shows an embodiment of a tee coupler to which a pair of tee extensions are joined to generate a base which maintains the support structure in a substantially fixed orientation to a support surface.

FIG. 3H shows an embodiment of a resiliently flexible restraining element.

FIG. 4A shows an alternate embodiment of the pitching screen invention.

FIG. 4B shows an alternate embodiment of the pitching screen invention.

FIG. 5 shows an embodiment of the pitching screen invention disassembled into the components shown by FIGS. 5A, 5B, and 5C stored in a single container.

FIG. 5A shows the linear support structure of an embodiment of the pitching screen invention disassembled into linear segments.

FIG. 5B shows an embodiment of the base having a pair of tees disassembled into a pair of tee couplers each having a pair of tee extensions.

FIG. 5C shows an embodiment of the net folded for storage.

FIG. 5D shows and embodiment of a container in which the disassembled components of an embodiment of the pitching screen invention can be stored.

IV. DETAILED DESCRIPTION OF THE PREFERRED EMBODIMENTS

Figure 1:
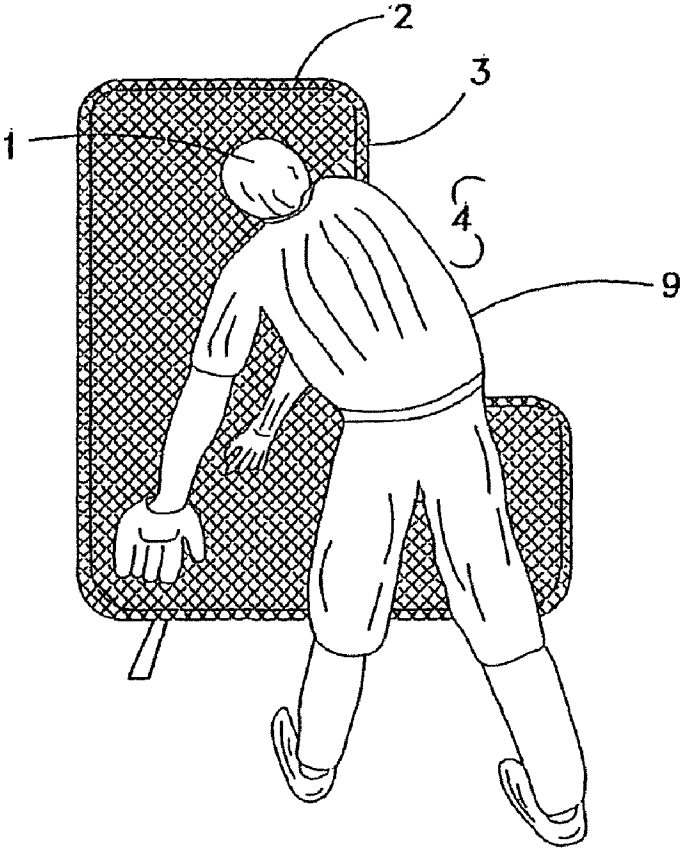
FIG. 1 shows a conventional L-screen with the body of a pitcher in a position which occurs after a pitch.

Now referring primarily to FIG. 1, a profile of pitcher (1) positioned after a pitch shows that a conventional L-shaped pitching screen (2) (a substantially square screen having a cutout (3) of substantially square or rectangular configuration which provides an a single pitching lane (4)) may not protect a portion of the pitcher (1) from batted balls (not shown). Batted balls that pass through a substantially square or rectangular cutout (3) can result in injury to the pitcher (1) which may be especially harmful because injury can occur on the throwing arm side of the pitcher's (1) body.

Figure 2:
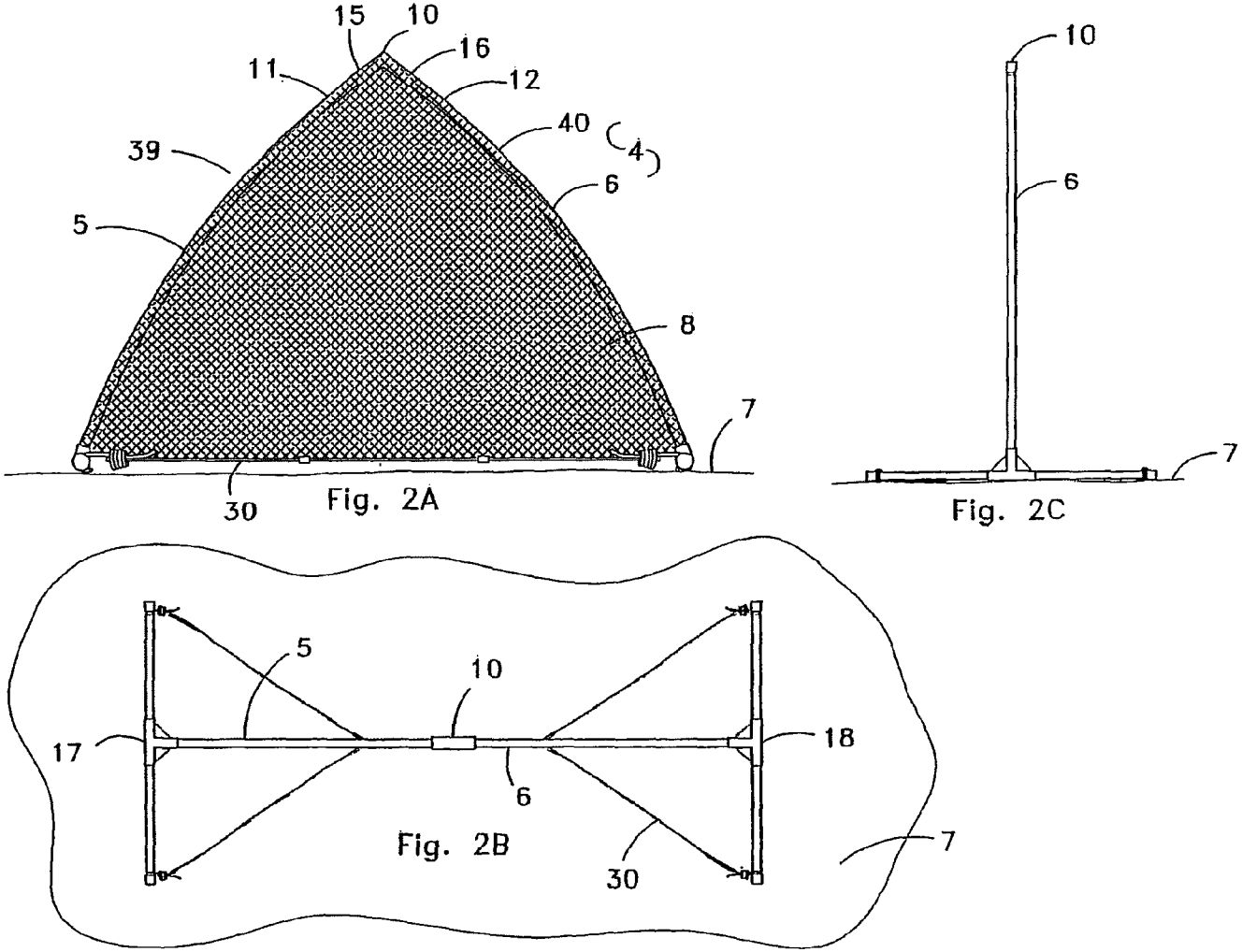
FIG. 2A shows a front view of an embodiment of the pitching screen invention having an arcuate support elements.
FIG. 2B shows a top view of an embodiment of the pitching screen invention having arcuate support elements.
FIG. 2C shows an end view of an embodiment of the pitching screen invention having arcuate support elements.

Now referring primarily to FIGS. 2A, 2B, and 2C which provide a front view, top view and side view of a non-limiting example of a pitching screen in accordance with the invention, a first arcuate support element (5) and a second arcuate support element (6) can be positioned a distance apart in substantially bilateral symmetry about an axis which extends vertically from a support surface (7). The first arcuate support element (5) and the second arcuate support element (6) provide a support structure to which an object deflection material (8) can substantially conform.

Now referring primarily to FIG. 1 and FIG. 2A, it can be understood that the profile of the pitcher (1) positioned after a pitch (as shown by FIG. 1) includes an arcuate profile (9) the curvature of which can be protected from batted balls by the configuration of the first arcuate support element (5) or the second arcuate support element (6) depending the handedness of the pitcher (1). The example of the arcuate support elements (5)(6) shown by FIG. 2A is not intended to be limiting with respect to the numerous and wide variety of configurations which the arcuate supports (5)(6) or pitching screens including an arcuate support element can take to protect the arcuate profile (9) of the pitcher (1) and still allow the pitcher at least one pitching lane (4) in which the trajectory of the ball can pass. Preferred embodiments of the pitching screen invention similar to that shown in FIG. 2A may provide at least one arcuate support element (5) or (6) which defines a portion of a circle of greater or lesser radius of between about 36 inches and about 120 inches. A specific example of the pitching screen invention as shown in FIG. 2A provides a radius of between about 36 inches and about 72 inches.

As to other embodiments of the pitching screen invention, the arcuate support elements may be configured to be similar, match, or correspond to the arcuate profile (9) of the pitcher (1) positioned after follow through from a pitch. Depending on the stature of the pitcher (1) the configuration of the arcuate supports (5) (6) may vary to allow a greater portion of the arcuate profile (9) of the pitcher (1) to be protected from batted balls after the pitch than is afforded by conventional pitching screen technology. As such, the term arcuate support or arcuate support element is not meant to be limiting but rather to expansively encompass the numerous and varied support structures configured with at least one support element having curvature that can protect the arcuate profile (9) of the pitcher to a greater degree than conventional pitching screen technology.

The arcuate support elements (5) (6) can be produced from a variety of materials including, but not limited to, plastic, such as polyvinylchloride, virgin polyvinylchloride, acrylonitrile butadiene styrene, or the like; expanded crosslinked polymers; various types of metals such as aluminum; and composite materials such as fiberglass, carbon fiber, or the like, or various permutation and combinations of each. The configuration of the arcuate supports in cross section can be any desired geometry, such as, circular, oval, rectangular, square, triangular, trapezoidal, L-shaped, or the like. A preferred embodiment of the arcuate support elements (5) (6) as shown in FIG. 2A can be produced from tubular polyvinyl chloride having a circular cross section, but this is not intended to be limiting with respect to other embodiments of the invention in which the arcuate support elements (5) (6) can be produced from solid, semisolid, cellular, hollow, or other materials that can be configured in an arcuate configuration in accordance with the invention.

Again referring primarily to FIG. 2A, the object deflection material (8) can be a net having apertures sufficiently small to deflect batted balls. The net can be generated from a variety of materials such as nylon, polyethylene, polypropylene, polyester, acrylic, metal strands, cotton fiber, Gore-Tex®, or the like, separately or in various combinations or permutations. The net made from these various materials, and others, can also be coated with a layer of a second material, such as: vinyl, latex, or rubber. The net can have apertures from about 0.25 millimeter to about 50 millimeters depending on the pitching application. The apertures can be of various geometry, such as: square, rectangular, hexagonal, diamond, or the like. With respect to a preferred embodiment of the invention, the net can provide square apertures of about two inches by about two inches. Alternately, the object deflection material could be a mesh or a web; plastic sheeting; a woven sheeting, or the like.

Now again referring primarily to FIG. 2A and FIG. 3A, certain embodiments of the invention can further include a coupler (10) to which said first arcuate support (5) and said second arcuate support element (6) are coupled. The coupler (10) can be configured to allow slidable insertion of a first end (11) of the first arcuate support element (5) and a first end (12) of the second arcuate support element (6) into corresponding one each of a first coupler receptacle (13) and a second coupler receptacle (14). While the coupler (10) as shown in FIG. 2A has a first coupler leg (15) and a second coupler leg (16) disposed at about a ninety degree angle, embodiments of the pitching screen invention can provide the coupler (10) in a variety of configurations. For example, the first coupler leg (15) and the second coupler leg (16) can be disposed at an angle of between about eighty degrees and about one hundred degrees. Alternately, the legs (15) (16) of the coupler (10) could independently rotate about the axis of a shaft to provide a variably adjustable angle between the first arcuate support (5) and the second arcuate support (6). Other embodiments of the invention, can provide a coupler (10) having a rectangular configuration to extend the screen vertically as shown for example by FIG. 4A. Naturally, embodiments of the pitching screen invention can include a coupler (10) of any desired shape which allows the arcuate support elements (5) (6) to be disposed in a manner which protects the arcuate profile (9) of a pitcher to a greater extent than the conventional technology.

Now referring primarily to FIGS. 2B and 2C, the pitching screen invention can further include a base which maintains the support structure in substantially fixed orientation to a support surface (7). As shown by FIG. 2B, the base, as to certain embodiments of the invention, can comprise a first tee element (17) and a second tee element (18). The first tee element (17) and the second tee element (18) can each be a single integral piece with legs extending a sufficient length to maintain orientation of the first arcuate support element (5) and the second arcuate support element (6) to the support surface (7) as desired. Other embodiments of the pitching screen invention can provide tee elements (19) (20) which have a pair of removable legs (21) (22) and (23) (24) (See FIG. 3A). The tee elements as above-described are not intended to be limiting with respect to the numerous and varied configurations of bases which can be utilized to establish the support structure in a particular orientation with respect to the support surface (7). The base could alternately be configured as round, square, or oval pedestals; or include additional legs; stakes (with or without guy wires); or any base configuration which can be utilized to orient the support structure of the pitching screen to the support surface (7) in accordance with invention (naturally some flexure or movement of the support structure will occur depending on the material from which the pitching screen is configured and the manner of joining any segments or components of the support structure).

Figure 3:
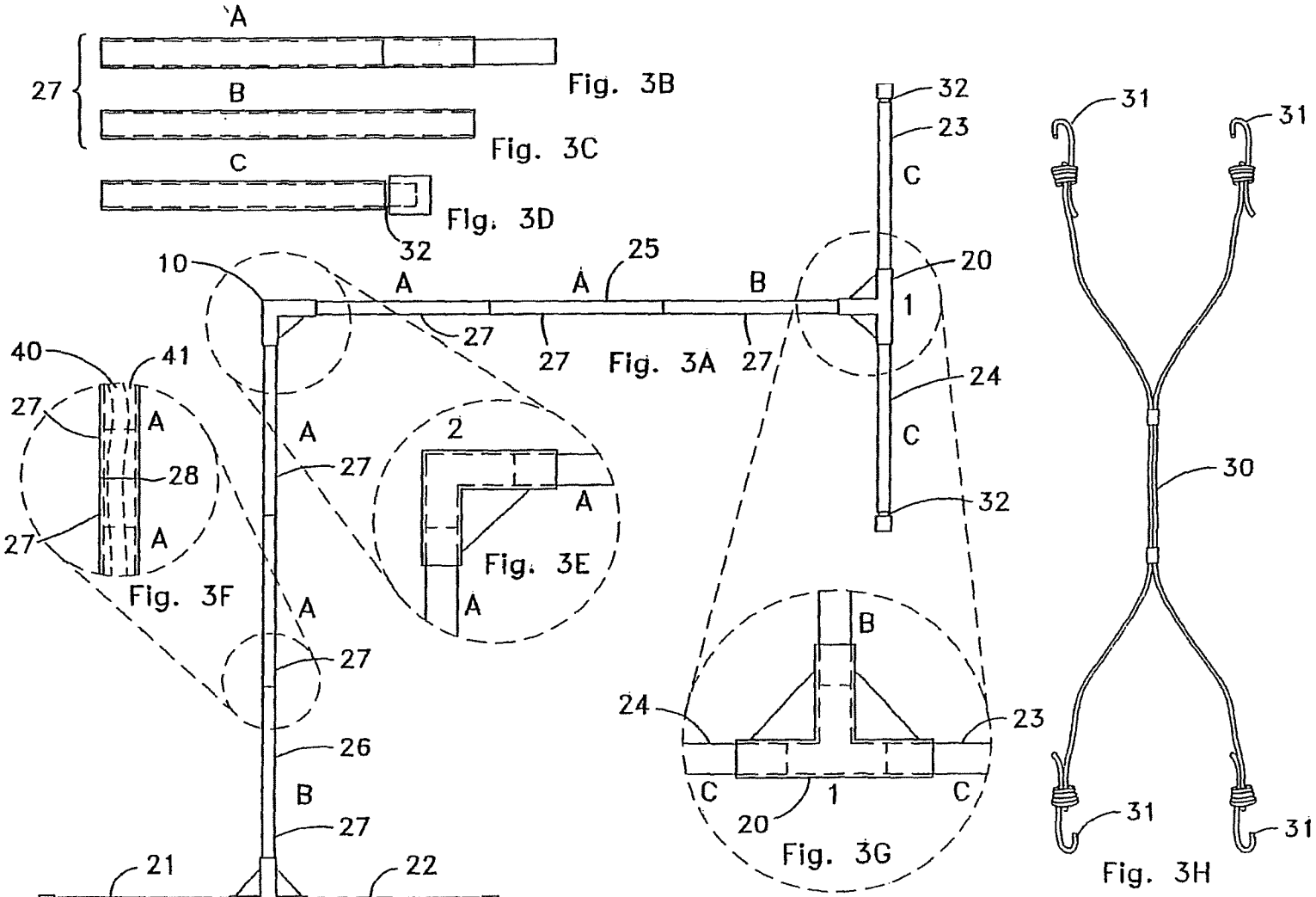
FIG. 3A shows an embodiment of the pitching screen invention having linear support structure generated by coupling a plurality of axially coupled linear support elements.
FIG. 3B shows an embodiment of a linear support segments.
FIG. 3C shows another embodiment of a linear support segment.
FIG. 3D shows an embodiment of a tee extension.
FIG. 3E shows an embodiment of a coupler into which the linear support elements are joined.

Now referring primarily to FIG. 3, an alternate embodiment of the pitching screen invention as shown by FIG. 3A provides a first linear support element (25) and a second linear support element (26) which can be disposed a distance apart in bilateral symmetry to protect the pitcher (1) after a pitch. The first linear support (25) and the second linear support (26) can be configured to provide a structural support which corresponds to the physical stature of the pitcher being protected. Similar to the arcuate supports above-described the linear support elements (25) (26) can be generated from the same kinds, types, and configurations of materials.

As shown further shown by FIG. 3A, each of the first linear support element (25) and the second linear support element (26) can be generated from a plurality of linear support segments (27), such as those shown by FIGS. 3B, 3C, and 3D which can be slidely engaged to couple as shown by FIG. 3F. A variety of alternate coupling configurations can used to generate the first linear support element (25) and the second linear support element (26) from the plurality of linear support segments (27), such as mated spiral threads, joints rotatable about the axis of a shaft, ball joints, or the like. A preferred embodiment of the pitching screen invention which has axially coupled linear support segments (27) can further include a plurality of elastically tensioned couplings (28) (alternate embodiments of the pitching screen invention as above-described or otherwise can also include elastically tensioned couplings). The elastically tensioned couplings can be generated by providing a resiliently elastic cord (40) located in the hollow space (41) of the tubular linear support segments (27). The resiliently elastic cord (40) can be sufficiently tensioned to assist in establishing and maintaining the linear support segments (27) in the assembled configuration. Alternately, resiliently elastic bands, resiliently elastic cord, resilient elastic tubular sleeves, or the like could be engaged with the exterior surface of the linear support segments (27) to provide a similar elastically tensioned coupler (28).

The pitching screen embodiment as shown by FIG. 3A can further provide the coupler (10) above-described to which the first end of the first linear support element (25) and the first end of the second linear support element (26) can slidely engage. The coupler (10) can be configured to establish the first linear support element (25) and the second linear support element (26) at an angle between about eighty degrees and about one hundred degrees. Alternately, the legs (15)(16) of the coupler (10) can independently rotate about the axis of a shaft to provide a variably adjustable angle between the first linear support segment (25) and the second linear support segment (27). Other embodiments of the pitching screen invention, can provide a coupler (10) having a rectangular configuration to extend the screen vertically similar to that shown by FIG. 4A (arcuate support elements (5)(6) replaced with linear support elements (25)(26)).

Again referring to FIG. 3A, the pitching screen invention can further include a base as described above having a tee (19) (20), or alternative configurations, coupled to the second end of each of the first linear support element (25) and the second linear support (26) to establish the linear support structure in a substantially fixed orientation to the support surface (7).

Again referring primarily to FIGS. 2B, 3A and 3H, as to certain embodiments of the invention, the first linear support element (25) and the second linear support element (26), or arcuate support elements (5)(6), can be made responsive to the corresponding ends of a restraint element (30) which can assist in maintaining the desired distance or angle between the first linear support element (25) and the second linear support element (26). As to certain embodiments of the pitching screen invention, the restraint element (30) can be bifurcated at the ends to provide fixed or removable securement to a corresponding pair of legs (21)(22) and (23)(24) coupled to the first tee element (19) and the second tee element (20) respectively, as shown by FIG. 2B. As to certain embodiments of the pitching screen invention, removable securement can provided by hooks (31) which can be mated with a corresponding each of a circumferential groove (32). The restraint elements (30) illustrated by FIGS. 2B and 3H are not intended to be limiting with respect to the numerous and varied embodiments of the restraint element (30) which can be used in accordance with the invention which include, but are not limited to, a single cord established between the first linear support (25) and the second linear support (26); or a single resiliently elastic cord having variable adjustable length; or a resiliently elastic cord having one or more bifurcated ends.

As to certain preferred embodiments of the pitching screen invention, the first end of the first linear support (25) (whether a single piece or coupled linear segments) and the first end of the second linear support (26) (whether a single piece or coupled linear segments) can be joined to the coupler (10) having a fixed angle. The second end of the first linear support element (25) and the second end of the second linear support element (26) can be made responsive to the restraint element (30). The configuration of the restraint element (30) can be selected to generate flexure in the first linear support element (25) or flexure in the second linear support element (26), or both, as an alternate method of establishing a first arcuate support element (5) and a second arcuate support element (6). Alternate embodiments of the first linear support element (25) and the second linear support element (26) (depending on the material utilized) can provide greater or lesser flexure in response to restraint element (30). As such, certain embodiments of the linear support elements (25)(26) can provide sufficient flexure to provide a first arcuate support element (5) and a second arcuate support element (6) in which the flexure or curvature can be altered to correspond to, more closely correspond to, or match to the arcuate profile (9) of a pitcher (1) positioned after throwing a pitch.

Now referring primarily to FIG. 4, a generic pitching screen in accordance with the invention provides numerous and varied embodiments each establishing a first pitching lane (33) for a right-handed pitcher and a second pitching lane (34) for a left-handed pitcher in a single pitching screen. By providing a first pitching lane (33) and a second pitching lane (34) in the same pitching screen, the pitching screen does not have to be re-positioned between serial use by a left-handed pitcher and a right handed pitcher, or vice-versa. A particular embodiment of the generic pitching screen invention as shown by FIG. 4B provides a first square or rectangular cutout (35) on the right side and a second square or rectangular cutout (36) on the left side of the same pitching screen which provide a first pitching lane and a second pitching lane (produced by configuring the pitching screen with a cutout area or relief in the pitching screen in which the path of a pitched ball can pass on its way to the pitching target, such as the strike zone of a batter or the target of a catching screen). Another particular embodiment of the generic pitching screen invention shown by FIG. 4A provides a first partial arcuate cutout (37) and a second partial arcuate cutout (38) in the same pitching screen to provide a first pitching lane and a second pitching lane. Another embodiment of the generic pitching screen invention as shown by FIG. 4A provides an first angled cutout and a second angled cutout in the same pitching screen to provide a first pitching lane and a second pitching lane. Embodiments of the pitching as shown by 4A and 4B can further include a coupler (10) joined to the linear or arcuate supports (5)(6) which provides a screen extension element (44). A preferred embodiment of the generic pitching screen invention as shown by FIG. 2A provides a first arcuate cutout (39) and a second arcuate cutout (40) to provide a first pitching lane and a second pitching lane. These various examples of embodiments of the generic pitching screen invention which provide a first cutout and a second cutout in the same pitching screen are not intended to be limiting with respect to the various embodiments of pitching screens which are encompassed by the generic pitching screen invention, but rather are intended to be illustrative of the numerous and varied configurations of pitching screens which can be made and used in accordance with the invention.

Now referring primarily to FIG. 5, certain embodiments of the pitching screen invention can be provided as a kit which includes a folded configuration (39) of a plurality of linear segments (27) which can have elastically tensioned couplers (28) (or without elastically tensioned couplers), as shown by FIG. 5A. The plurality of linear segments (27) can be of tubular configuration as shown in FIG. 5A each having a length of between about 24 inches and about 36 inches and having an outside diameter of between about one inch and one and one-half inches with a wall thickness of between about three thirty seconds of an inch to about three sixteenths of an inch.

The embodiment of the kit shown by FIG. 5, provide a folded configuration of the plurality of linear segments (27) of the first linear support element (25) and the second linear support element (26) which slidely insert into the coupler (10) without removing the elastic cord (40) which can run within the hollow (41) of the tubular linear segments (27) to generate the elastically tensioned coupler (28). The folded configuration (39) of the linear support elements (25)(26) can then be located, stored, or transported in a case (42)(such as the case shown by FIG. 5D which can be between about 30 inches and about 40 inches in length and can have a diameter of between about 10 inches and about 20 inches. The case (42) can be made of a substantially rigid construction or a flexible construction with a non-limiting preferred embodiment of the invention made from a flexible woven material with a zipper or mated hook and loop closure (43) (such as Velcro®), as shown.

The kit to generate a pitching screen in accordance with the invention can further include an amount of object deflection material (8) (FIG. 5C) configured to conform to the configuration of the particular embodiment of the pitching screen invention when assembled. The object deflection (8) material as shown can be a net which can be folded for storage in the container (42).

The kit can further include a base as shown by FIG. 4D. The base can comprise the embodiment shown being a pair of single piece tees (17) and (18) each attached to the bifurcated end of the restraint element (30).

Again referring primarily to FIG. 4B, the pitching screen invention described above can further include a pitching target or a batting target (43) so that the pitching screen can also be used as a catch screen to stop pitched or batted balls. The pitching target or batting target can provide a sensorial perceivable indicia, such as color, reflective material, fluorescent material, or the like, which indicates the target area (44). The pitching target or batting target (43) can as to other embodiments of the invention provide a target pouch (45) in which balls are collected.

Now referring primarily to FIG. 4A, the pitching screen invention described above can further include a left hand net cutout (48) or a right hand net cutout (49), or both, so that the pitching screen invention can be utilized for underhand pitching.

As can be easily understood from the foregoing, the basic concepts of the present invention may be embodied in a variety of ways. The invention involves numerous and varied embodiments of a generic pitching screen which provides a first pitching lane and a second pitching lane in a single pitching screen and methods of making and using such pitching screen and a pitching screen which has a support structure which includes linear or arcuate elements which protect the arcuate profile of a pitcher in the position after the pitch is thrown.

As such, the particular embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "pitch" should be understood to encompass disclosure of the act of "pitching"—whether explicitly discussed or not—and, conversely, were there effectively disclosure of the act of "pitching", such a disclosure should be understood to encompass disclosure of a "pitch" and even a "means for pitching." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the pitching screens herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A method of producing a pitching screen, comprising the steps of:

providing a base;

providing a first arcuate support element having a length disposed between a first end and a second end;

providing a second arcuate support element having a length disposed between a first end and a second end;

coupling each of said first arcuate support element and said second arcute support element to a base by said second ends establishing said second ends a distance apart, said first arucate support element and said second arcuate support element inwardly curving to establish said first ends at a lesser distance apart than said second ends; and coupling an object deflection material having a plurality of apertures to said first arcuate support element and said second arcuate support element to provide an object deflection surface between said first arcuate support element and said second arcuate support element.

2. The method of producing a pitching screen of claim 1, wherein said first arcuate support element and a second arcuate support element can be positioned said distance apart in substantially bilateral symmetry about a vertical axis.

3. The method of producing a pitching screen of claim 1, wherein said lesser distance apart comprises less than one half of said distance apart of said second ends coupled to said base.

4. The method of producing a pitching screen of claim 1, further providing a coupler which joins said first ends.

5. The method of producing a pitching screen of claim 3, wherein each of said first arcuate support element and said second arcute support element coupled to said base by said second ends establish said first ends at a height above said base of between about 60 inches and about 120 inches.

6. The method of producing a pitching screen of claim 5, wherein said first arcuate support element and said second arcuate support element produces a curvature between said first end and said second end having a radius of between about 36 inches and about 120 inches.

7. The method of producing a pitching screen of claim 1, wherein said base includes:

a first tee element which couples to said second end of said first arcuate support element; and a second tee element which couples to said second end of said second arcuate support element.

8. The method of producing a pitching screen of claim 1, wherein providing said first arcuate support element and said second arcuate support element comprises providing a first linear support element and a second linear support element each of which flexes sufficiently to dispose said second ends at said lesser distance apart compared to said first ends.

9. The method of producing a pitching screen of claim 8, wherein said first linear support element and said second linear support element have a length between said first end and said second end of between about 48 inches and about 120 inches.

10. The method of producing a pitching screen of claim 9, wherein flexure of said first arcuate support element and said second arcute support element disposes said first ends less than one half of said distance apart of said second ends coupled to said base.

11. The method of producing a pitching screen of claim 10, wherein flexure of said first arcuate support element and said second arcute support element coupled to said base by said second ends establish said first ends at a height above said base of between about 60 inches and about 120 inches.

12. The method of producing a pitching screen of claim 11, wherein flexure of said first linear support element and said second linear support element produces a curvature between said first end and said second end having a radius of between about 36 inches and about 120 inches.

* * * * *